US006735829B2

(12) United States Patent
Hsu

(10) Patent No.: US 6,735,829 B2
(45) Date of Patent: May 18, 2004

(54) U-SHAPED LACE BUCKLE

(75) Inventor: Hsiu-Hsuan Hsu, Chung-Li (TW)

(73) Assignee: Taiwan Industrial Fastener Corporation, Taipei (TW)

( * ) Notice: Subject to any disclaimer, the term of this patent is extended or adjusted under 35 U.S.C. 154(b) by 0 days.

(21) Appl. No.: 10/233,602

(22) Filed: Sep. 4, 2002

(65) Prior Publication Data

US 2003/0126726 A1 Jul. 10, 2003

(30) Foreign Application Priority Data

Oct. 15, 2001 (TW) ..... 90217532 U

(51) Int. Cl.[7] ..... A43C 7/00; F16G 11/00

(52) U.S. Cl. ..... 24/712.1; 24/18; 24/130; 24/712.9; 24/713.4; 24/713.6; 36/50.1

(58) Field of Search ..... 24/712.1, 712, 24/712.2, 712.9, 713.3, 713.6, 713.4, 130, 18; 36/50.1

(56) References Cited

U.S. PATENT DOCUMENTS 2,268,644 A * 1/1942 Dahlberg ..... 24/712.1
2,503,327 A * 4/1950 Fields ..... 24/130
3,357,674 A * 12/1967 Coanda et al. ..... 24/130
3,374,509 A * 3/1968 Logan et al. ..... 24/130
3,530,543 A * 9/1970 Desmarais et al. ..... 24/18
4,178,661 A * 12/1979 Klein ..... 24/130
5,158,428 A * 10/1992 Gessner et al. ..... 24/712.9
6,381,816 B1 * 5/2002 Lai et al. ..... 24/712.1
6,581,250 B2 * 6/2003 Matsushima et al. ..... 24/130

* cited by examiner

*Primary Examiner*—Victor Sakran
(74) *Attorney, Agent, or Firm*—Bacon & Thomas, PLLC

(57) ABSTRACT

A structure of a U-shaped lace buckle is disclosed. The U-shaped lace buckle comprises a shallow trench located at a central region. A releasing hole and a fastening hole are disposed within the central hollow region. The dimension of the releasing hole is larger than that of fastening hole. The releasing hole and the fastening hole are connected by a gradually tapering hole, wherein the dimension of the tapering hole connecting with the releasing hole is larger and the dimension of the tapering hole connecting with fastening hole is smaller. And the fastening hole comprises a plurality of protruded elements projecting from the inner surface. Further, the lace buckle comprises a through channel that passes from one end to the other end and connected through an arch-shaped groove located in between said two ends.

4 Claims, 10 Drawing Sheets

U-SHAPED LACE BUCKLE

BACKGROUND OF THE INVENTION

1. Filed of the Invention

The present invention relates to a lace buckle, and more particularly to a U-shaped lace buckle with a capability of firmly fastening in a fix position or releasing two ends of a lace, and resisting two end of the lace from pulled out by force.

2. Description of the Related Art

The use of lace or rope in our every day life is common, in that a lace may be used in shoes, tying bags and in clothing. Most commonly, a lace used in shoes, may be passed through holes of the shoes and ultimately the two ends of the lace are tied to form a slipknot so as to fasten lace in position. However, for example, after a long-hours in use, the slipknot may become loose and gets untied, as a result the shoes may come off or even at times the person with loose shoes may fall and sprain ankle due to losing of balance.

A conventional lace buckle has been developed to overcome the above problems. A conventional lace buckle is shown in FIG. 9. The lace buckle comprises a buckle base A, a fastening portion A2, a through channel A1 located on a side wall of the buckle base A, and an rotary plug B rotatably disposed into a central hollow opening which passes from a top to a bottom of the buckle base A and traverses through the channel A1. The lace is passed through the channel A1 in between the rotary plug B and the internal sidewall of the buckle base A. Then, the lace is pulled until a desired distance is reached, the lace will remain fastened in that position. As the lace is being pulled, and since the rotary plug B is free to rotate within the central hollow opening of the buckle base A, will rotate as the lace passes through the channel A1 in between the rotary plug B and the internal sidewall of the buckle base A, thus making the frictional force between the rotary plug B and the sidewall of the buckle base A as less as possible. Therefore, the action of tightening the lace can be done promptly without much effort and because of less frictional force is applied during the tightening, therefore the life of the lace can be extended. However, there are drawbacks from using the above-mentioned conventional buckle, in that since the rotary plug B is free to rotate within the central hollow opening of the buckle base A cannot efficiently secure the lace into position, and in order to secure in position, one need to tie a slipknot. Referring to FIG. 10, shows another conventional buckle comprising a buckle case C having a base C1 attached on the buckle case C, and an operative rod D, inserted in a hollow hole from a top of the base C1, secured by torsional spring E, and a turning handle F having a gear like surface F2 and a projected handle F1, operatively mounted on the base C1 of the buckle case C. The turning handle F is positioned as a preset angle, such that a lace can be passed through a gap between the gear like surface F2 of the turning handle F and an internal sidewall of the base C1 in the through channel C2, wherein the dimension of the gap is designed to be smaller than a diameter of the lace when the turning handle F is positioned in the preset angle, thus the lace can be secured in position between the gear like surface F2 of the turning handle F and the internal wall of the base C1 of the buckle case C in the through channel C2. To slip the lace out off case C, the turning handle F turned to increase the dimension of the gap in which the lace was secured. However, still there are drawbacks in the above-mentioned conventional buckle although it can more securely position the lace, buckle assembly required three major elements, thus the cost of manufacturing assembly parts and their material are higher. Therefore, a new lace buckle for overcoming the problems of the prior art, such as securing the lace in position as well as reduce manufacturing cost for make the lace buckle is highly desirable.

SUMMARY OF THE INVENTION

Accordingly, in the view of the foregoing, the present inventor makes a detailed study of related art to evaluate and consider, and uses years of accumulated experience in this field, and through several experiments, to create a new lace buckle of the present invention. The present invention provides an innovated cost effective U-shaped lace buckle for firmly fastening or releasing two ends of a lace, which can effectively prevent the two ends of the lace from being pulled out by force.

In order achieve the above objects and other objects of the present invention, a U-shaped lace buckle is provided. The U-shaped lace buckle comprises a shallow trench located at a central region. A releasing hole and a fastening hole are disposed within the central hollow region. The dimension of the releasing hole is larger than that of fastening hole. The releasing hole and the fastening hole are connected by a gradually tapering hole, wherein the dimension of the tapering hole connecting with the releasing hole is larger and the dimension of the tapering hole connecting with fastening hole is smaller. And the fastening hole comprises a plurality of gear elements projecting from the inner surface. Further, the lace buckle comprises a through channel that passes from one end to the other end and connected through an arch-shaped groove located in between said two ends.

According to an aspect of the present invention, the lace is inserted through the releasing hole and then the lace is squeezed through the tapering hole into the securing hole, in doing so, as the dimension of the securing hole is smaller than the lace therefore the securing hole will press against the sides of the lace to prevent the lace from dislodging from the lace buckle, and remain secured in position. The U-shaped lace buckle of the present invention is easy to use, and can be suitably applied for securing a variety of laces.

According to another aspect of the present invention the U-shaped lace buckle can be secured onto the surface of a suitable substrate such as shoes, garments, bags, and the like. The lace buckle can be secured by passing a lace through the channel from one end through the arch-shaped groove to the other end and positioned on the surface of an appropriate article and finally two distal ends of lace is stitched onto the surface of the article.

According to an aspect of the present invention, the U-shaped lace buckle can be manufactured using a plastic through a simple molding process, as one integral piece and requires no additional parts or accessories, therefore the manufacture of the lace buckle is more simplified and cost effective.

DESCRIPTION OF THE PREFERRED EMBODIMENTS

Figure 1:
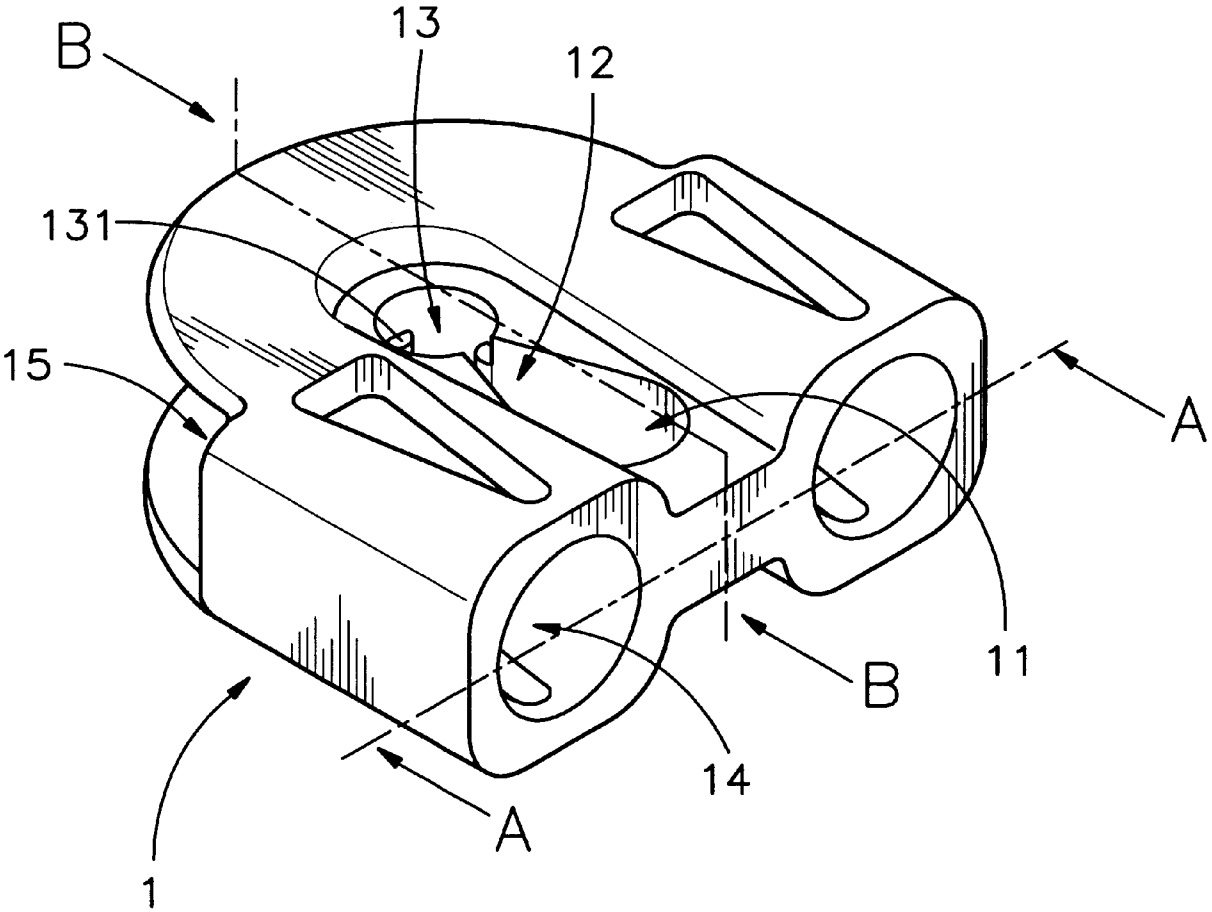
FIG. 1 is an elevational view of a U-shaped lace buckle of the present invention.

Reference will be made in detail to the preferred embodiments of the invention, examples of which are illustrated in the accompanying drawings. Wherever possible, the same reference numbers are used in the drawings and the description to refer to the same or like parts.

Referring to FIG. 1, shows a U-shaped lace buckle 1 of present invention made from single piece manufactured by using a plastic molding injection. The U-shaped lace buckle 1 comprises a shallow trench at a central region. A releasing hole 11 and a fastening hole 13 are disposed within the shallow trench. A dimension of the releasing hole 11 is larger than that of fastening hole 13. The releasing hole 11 and the fastening hole 13 are connected by a gradually tapering hole 12, wherein the dimension of the tapering hole 12 connecting with the releasing hole 11 is larger and the dimension of the tapering hole 12 connecting with fastening hole 13 is smaller. The fastening hole 13 comprises a plurality of protruded elements 131 projecting from the inner surface. A shape of the protruded elements 131 comprises but not limited to a gear, a teeth of saw, and a pointed cone. Further, the lace buckle 1 comprises a through channel 14 that passes from one end to the other end and connected through an arch-shaped groove 15 located in between said two ends.

Figure 2:
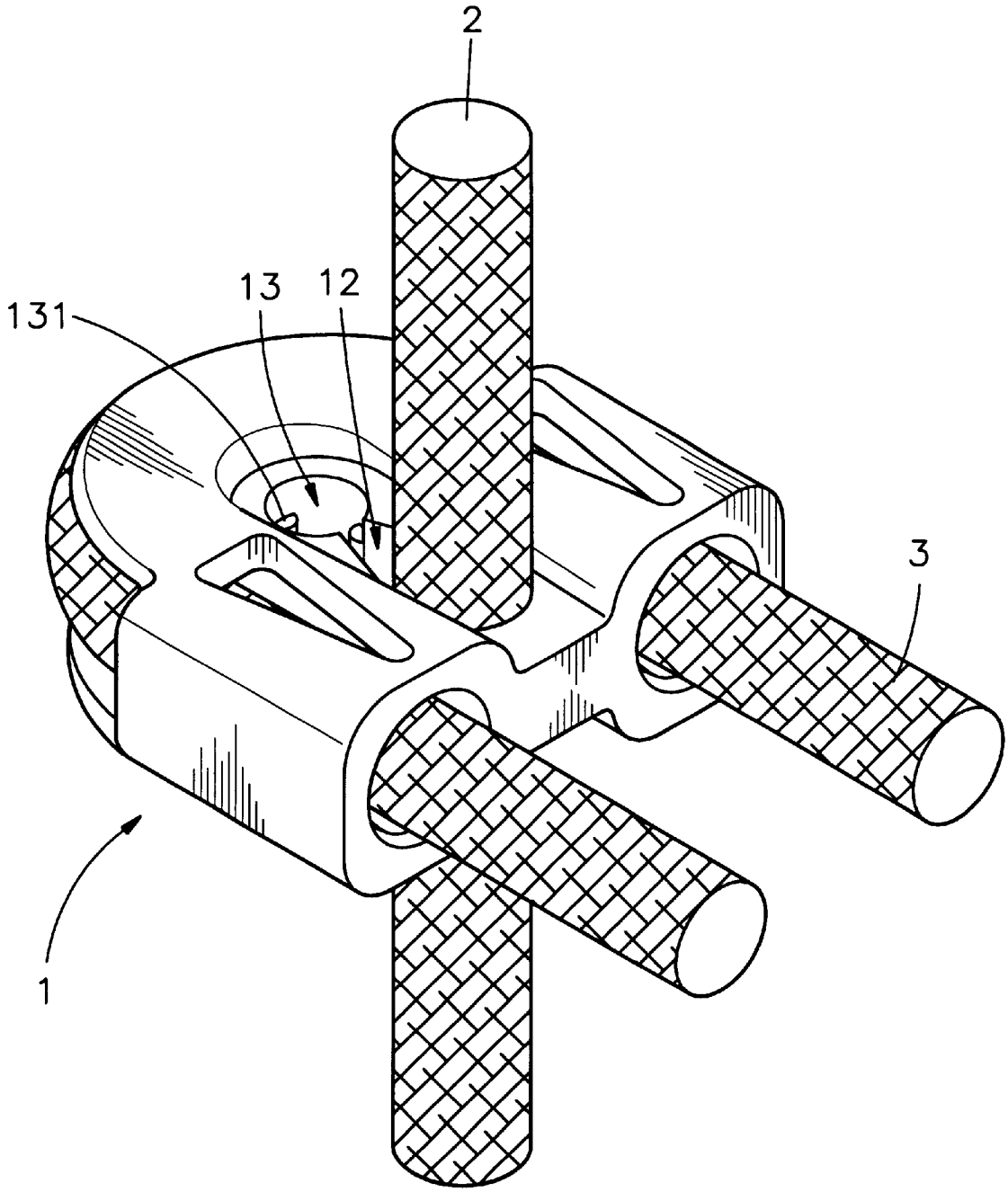
FIG. 2 is a view of the U-shaped lace buckle showing releasing of the lace according to the present invention.
Figure 4:
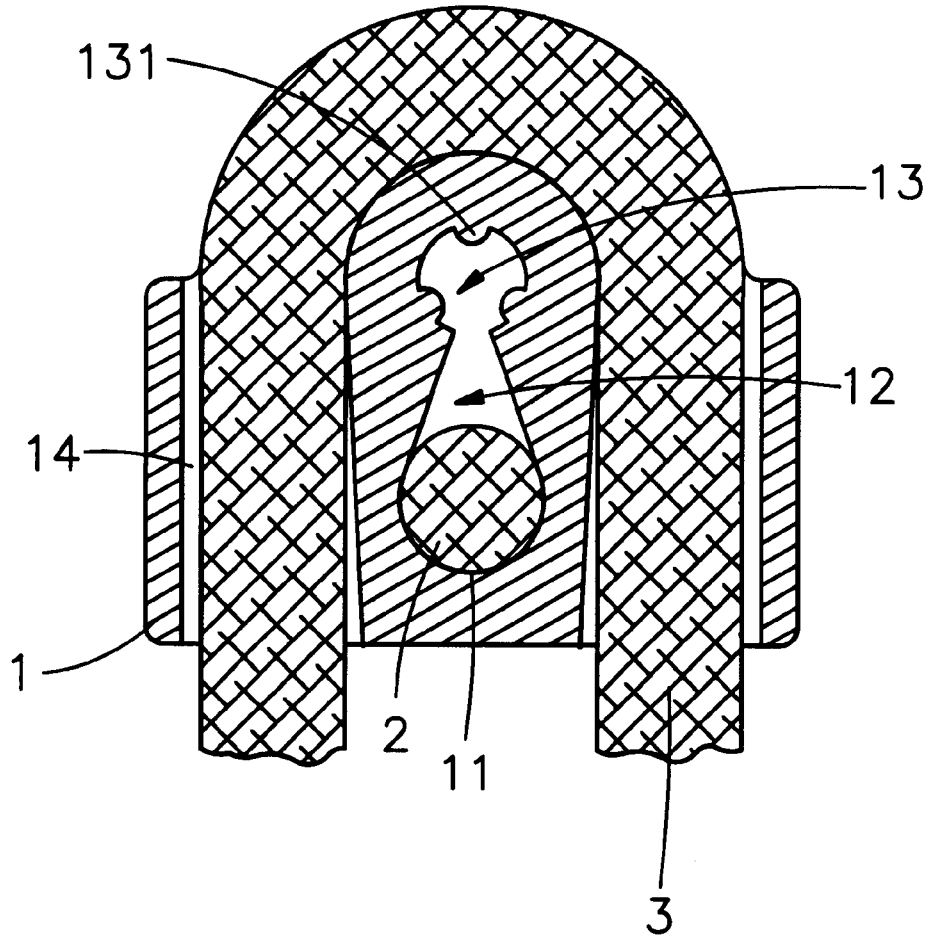
FIG. 4 is a sectional view of the U-shaped lace buckle taken along a line A—A showing the releasing of the lace according to the present invention.
Figure 5:
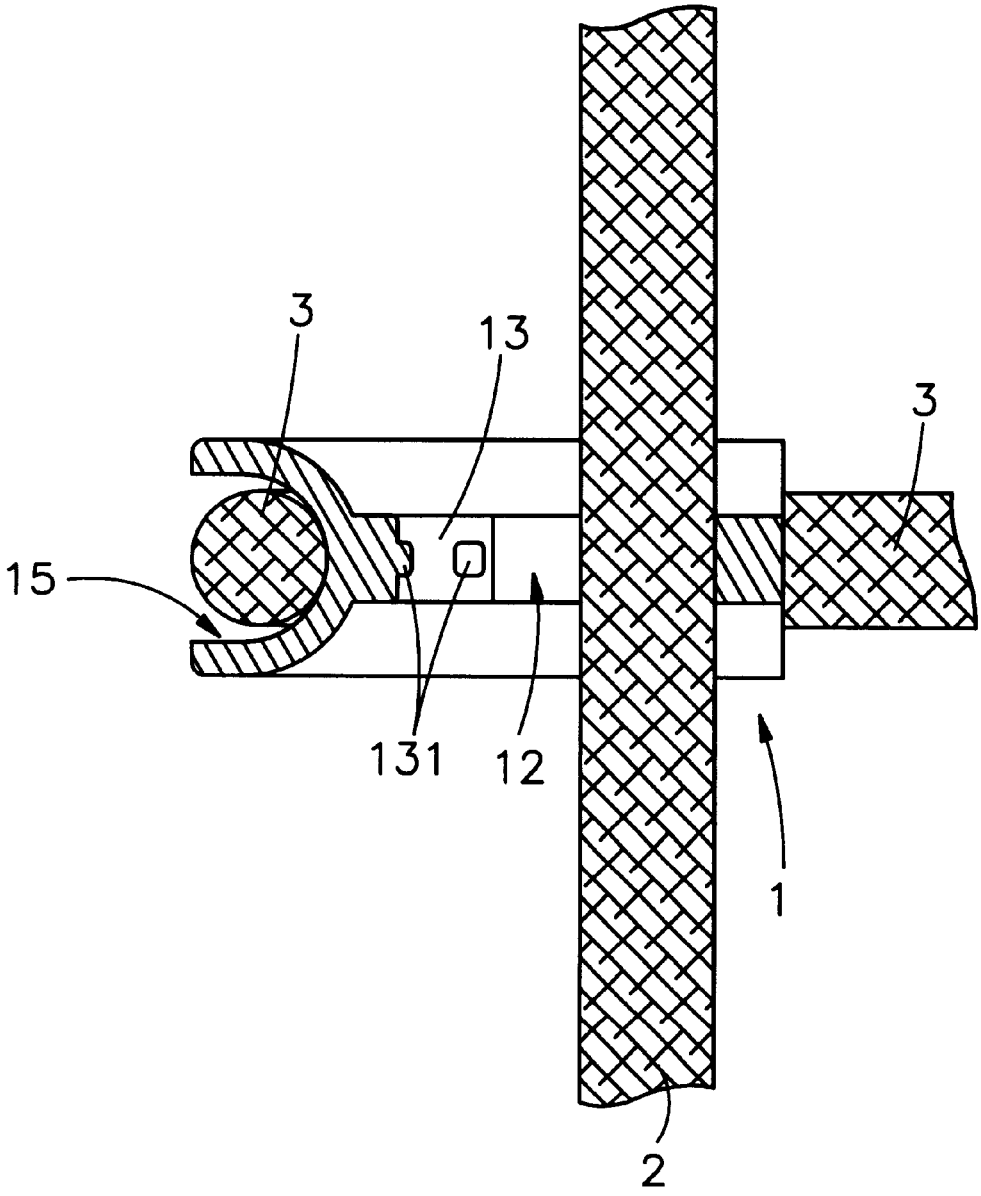
FIG. 5 is a sectional view of the U-shaped lace buckle taken along a line B—B showing the releasing of the lace according to the present invention.

Referring to FIGS. 2, 4 and 5, show a lace 2 is inserted through releasing hole 11 of the U-shaped lace buckle 1. The lace 2 can freely move through the releasing hole 11 for adjusting the lace to a proper position.

Figure 3:
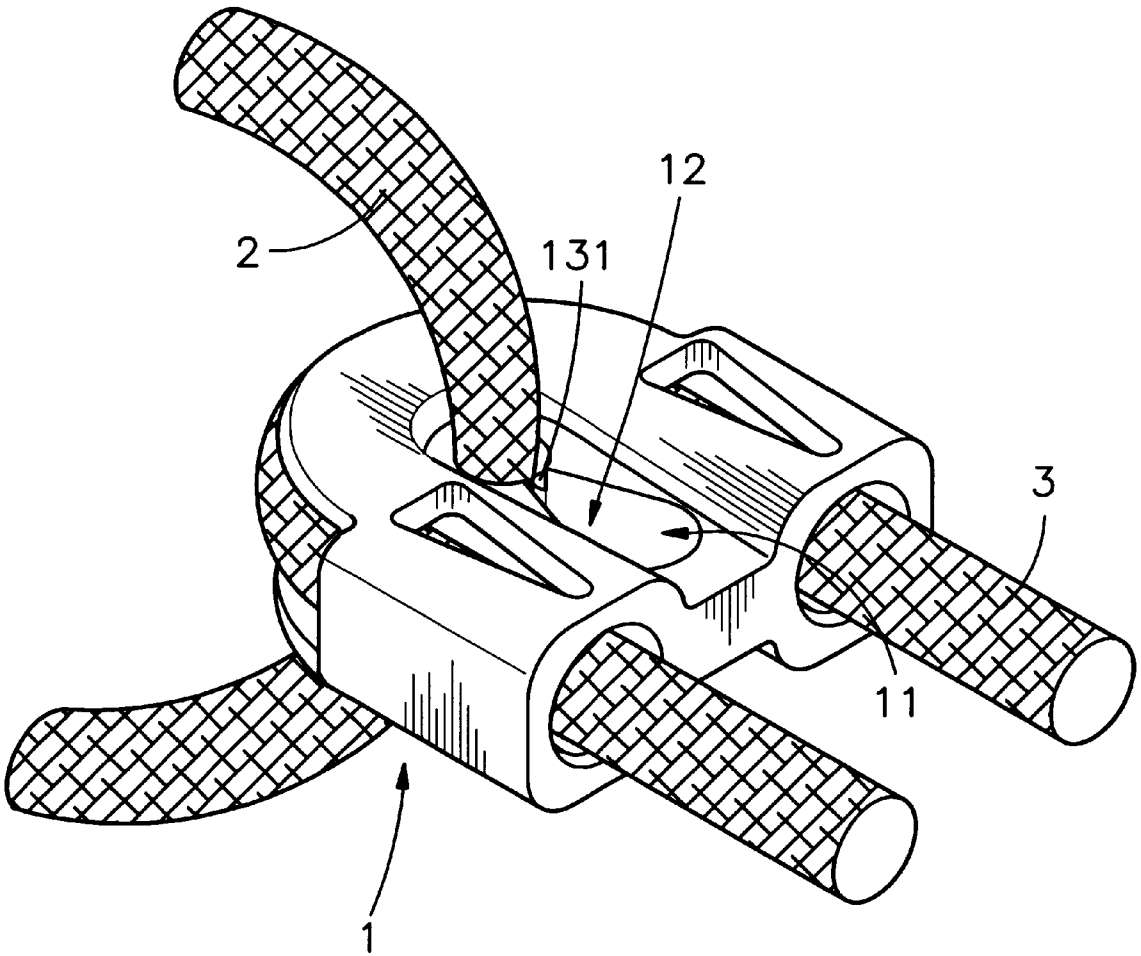
FIG. 3 is a view of the U-shaped lace buckle showing fastening of the lace according to the present invention.
Figure 6:
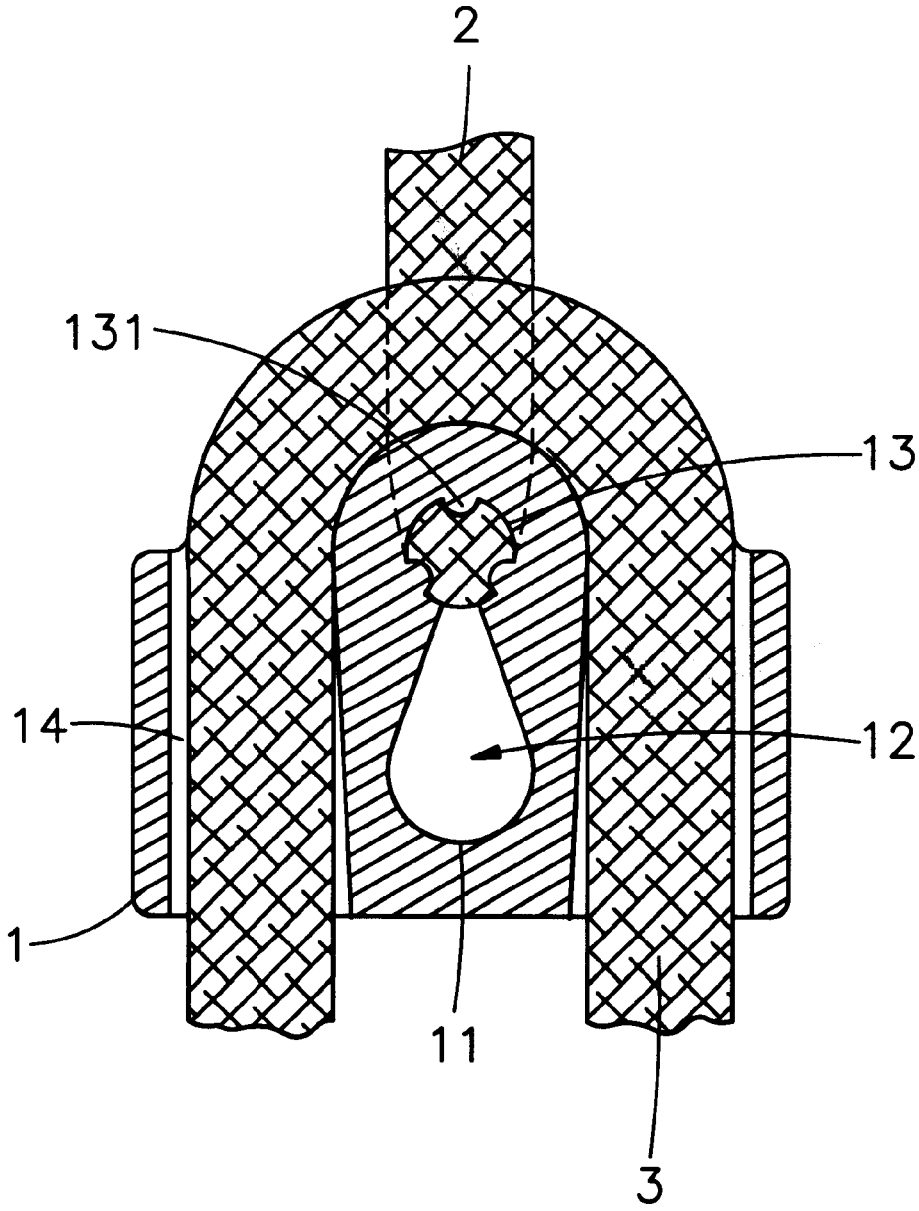
FIG. 6 is a sectional view taken from FIG. 3 along a plain through a U-shaped buckle
Figure 7:
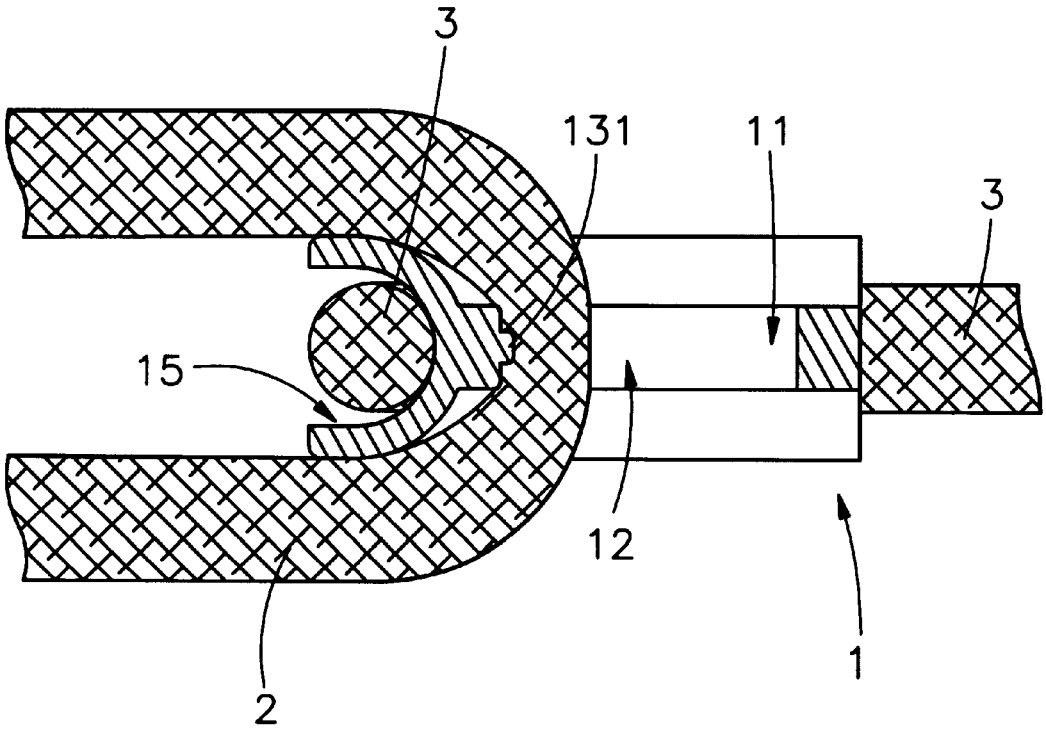
FIG. 7 is a sectional view of the U-shaped lace buckle taken along a line A—A showing the fastening of the lace according to the present invention.

Referring to FIGS. 3, 6 and 7, show the lace 2 is moved from the releasing hole 11 through gradually tapering hole 12 while the two sides of the lace 2 gets deformed as it squeezes through the gradually tapering hole 12 secured into the smaller dimensioned fastening hole 13. The protruded elements 131 within the fastening hole 13 provide sufficient pressing force to limit the lace 2 for moving backward and forward or right and left. Therefore the two ends of lace 2 is prevented from pulling out, thus the lace 2 is prevented from coming loose from the through hole. Further, the lace 2 may be squeezed from the fastening hole 13 through the gradually tapering hole 12 into the releasing hole 11 for releasing the lace 2.

Figure 8:
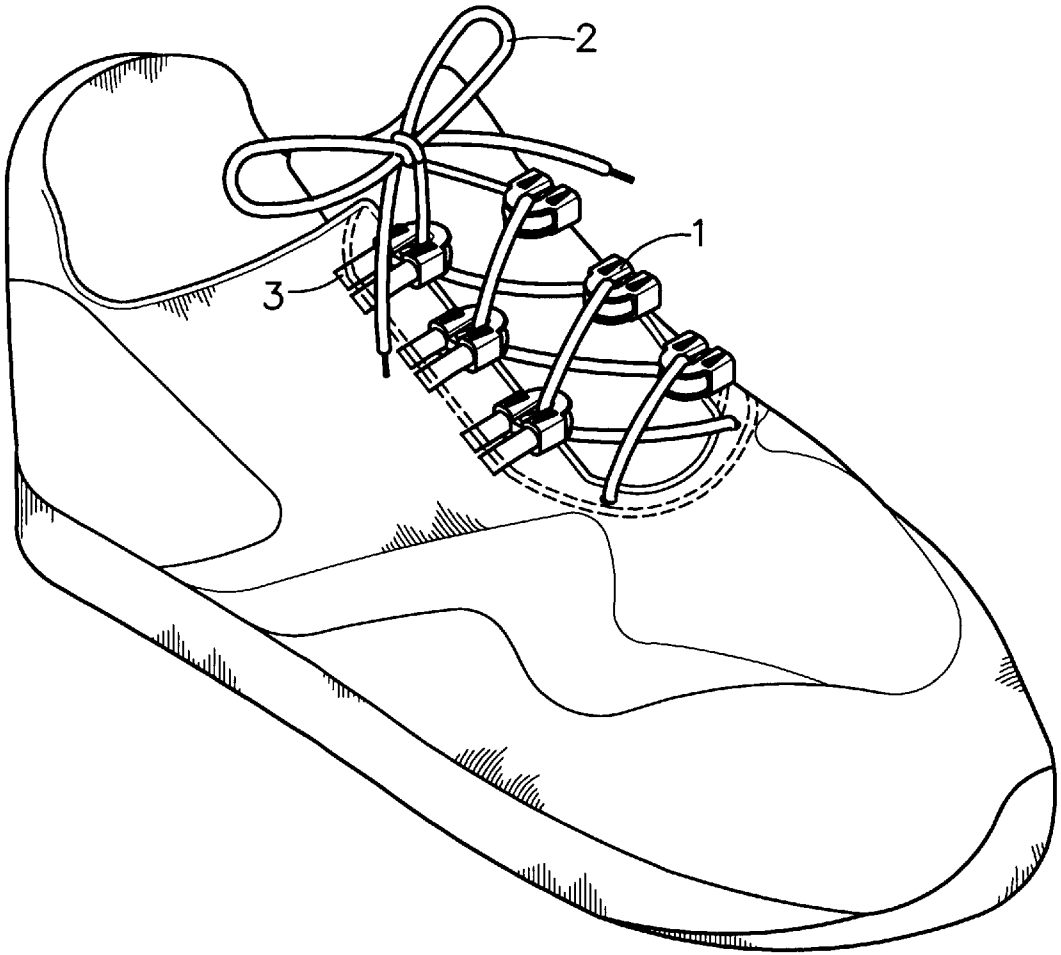
FIG. 8 is showing an aspect of applying the U-shaped lace buckle of the present invention onto the surface of a shoe.
Figure 9:
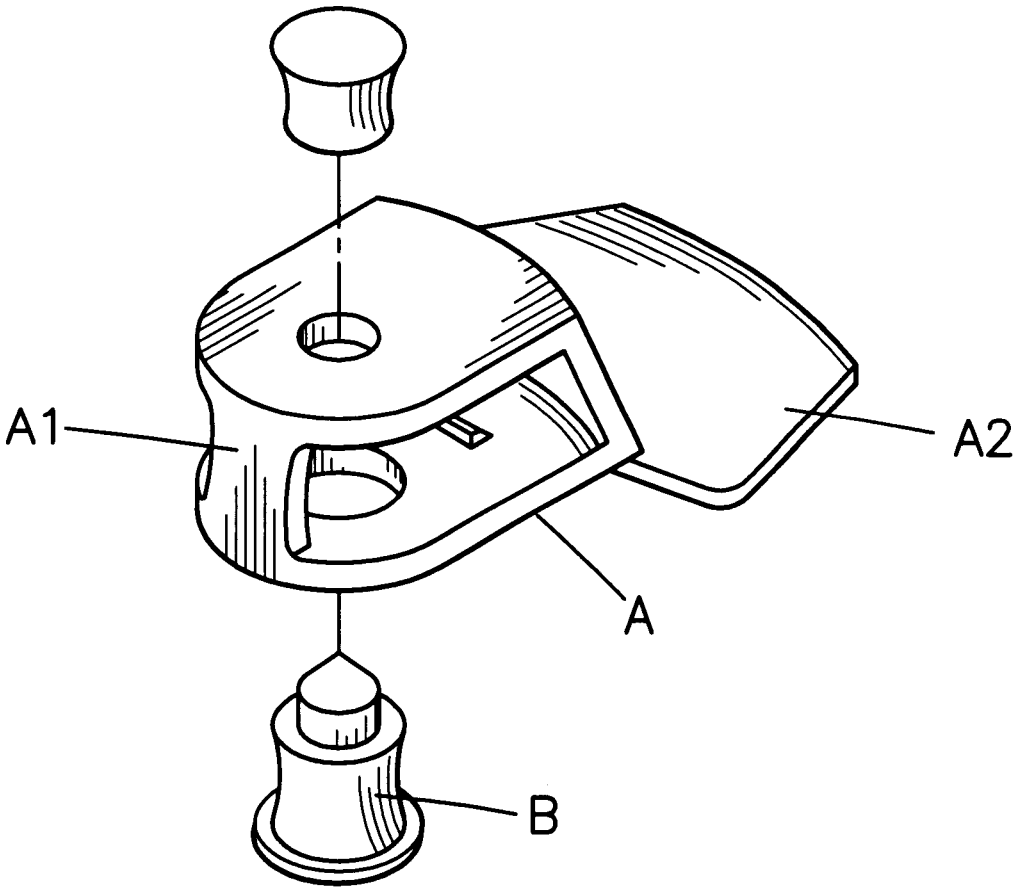
FIG. 9 PRIOR ART
FIG. 9 is an exploded view of a conventional buckle.
Figure 10:
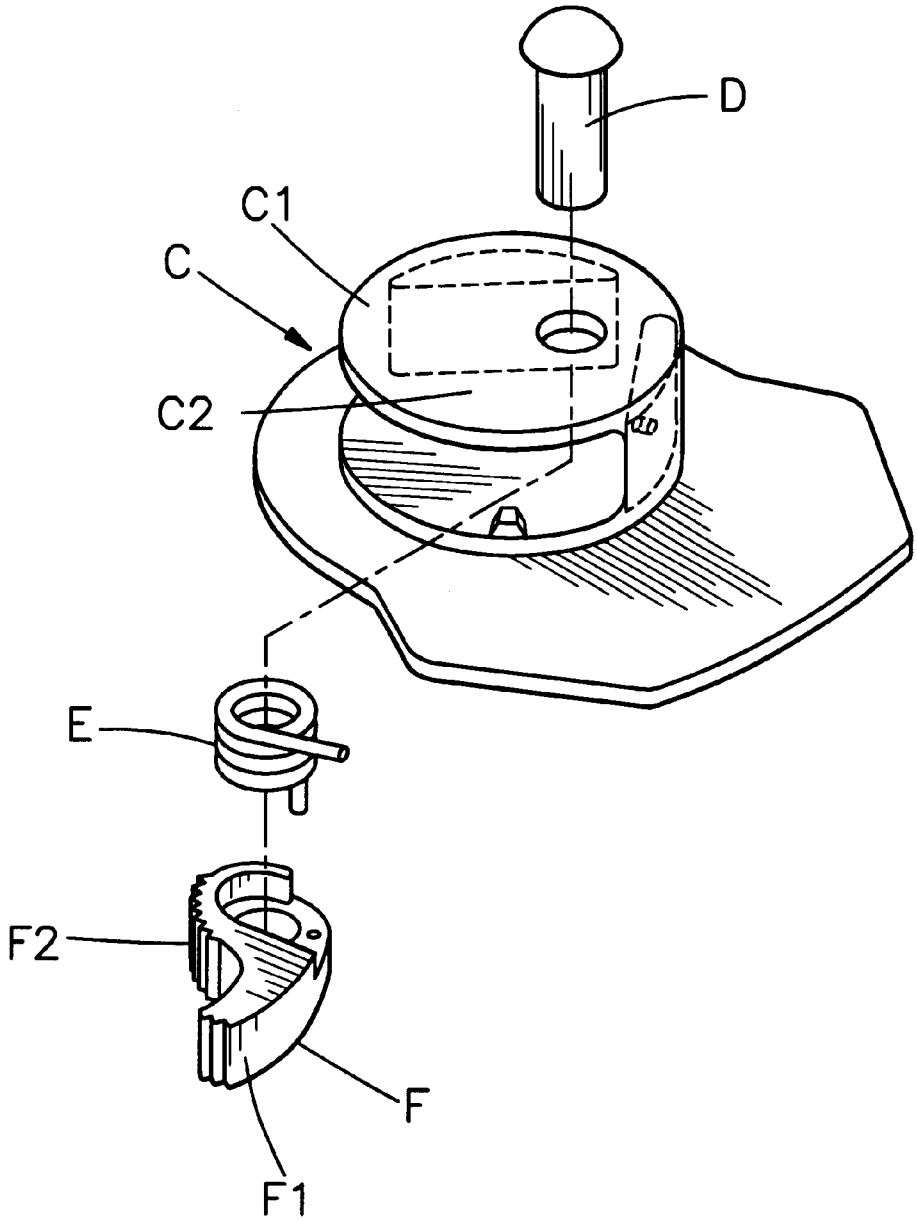
FIG. 10 PRIOR ART
FIG. 10 is an exploded view of another conventional buckle.

Referring to FIG. 8, shows a plurality of U-shaped lace buckles 1 of the present invention used on a shoe with the lace buckles 1 secured onto the surface of a shoe by passing a lace 3 through the channel 14 from one end through the arch-shaped groove 15 to the other end of the U-shaped lace buckle 1 (as shown in FIG. 1) and positioned on either side of shoe-tongue and finally two distal ends of lace 3 is stitched onto the surface of the shoe.

According to an aspect of the present invention, the lace buckle 1 can be manufactured using a plastic through a simple molding process, as one integral piece and requires no additional parts or accessories, therefore the manufacture of the lace buckle 1 is more simplified and cost effective.

According to another aspect of the present invention, the lace 2 can be moved freely through the large dimensioned releasing hole 11 allowing easy adjustment of the lace position and by merely squeezing the lace 2 through the gradually tapering hole 12 into the smaller dimensioned fastening hole 13 the lace 2 can be secured into position. Thus the use of the lace buckle 1 of the present is more simplified and convenient.

While the invention has been described in conjunction with a specific best mode, it is to be understood that many alternatives, modifications, and variations will be apparent to those skilled in the art in light of the a foregoing description. Accordingly, it is intended to embrace all such alternatives, modifications, and variations which fall within the spirit and scope of the included claims. All matters set forth herein or shown in the accompanying drawings are to be interpreted in an illustrative and non-limiting sense.

What the claimed is:

1. A U-shaped lace buckle, for shoes, bags, and garments, for securing a lace, securely fastened onto a surface thereof, comprising:

a shallow trench located in a central region of the U-shaped buckle;

a releasing hole and a fastening hole located within the shallow trench, wherein the dimension of the releasing hole is larger than that of fastening hole and wherein the releasing hole is for a lace to pass through freely and the fastening hole is for fastening the lace and preventing the lace from pulling out;

a gradually tapering hole connecting the releasing hole and the fastening hole, the lace from the releasing hole can be squeezed through the gradually tapering hole to the fastening hole for securing the lace and vice versa for releasing the lace; and a through channel disposed on each end, wherein said two through channels are conjoint by an arch-shaped groove for passing one end of a lace from one through channel through the groove of the arch-shaped groove to the other through channel, and then the two ends of the lace is securely fastened onto a surface of a suitable substrate.

2. The U-shaped lace buckle according to claim 1, wherein the fastening hole comprise a plurality of protruded elements aligned on the surface of inner side to provide pressing force for securing the lace.

3. The U-shaped lace buckle according to claim 2, wherein a shape of the protruded elements comprises at least one selected from the group consisting of a gear, a teeth of saw, and a pointed cone.

4. The U-shaped lace buckle according to claim 1, wherein the substrate is selected from the group consisting of a shoe, a bag, a garment, and the like.

* * * * *